US006807688B1

(12) United States Patent
Popowski et al.

(10) Patent No.: US 6,807,688 B1
(45) Date of Patent: Oct. 26, 2004

(54) POOL COVER SUPPORT

(76) Inventors: Anna Popowski, 28 Oxford Rd., Colonia, NJ (US) 07067; Chester Popowski, 28 Oxford Rd., Colonia, NJ (US) 07067

( * ) Notice: Subject to any disclaimer, the term of this patent is extended or adjusted under 35 U.S.C. 154(b) by 0 days.

(21) Appl. No.: 10/463,307

(22) Filed: Jun. 18, 2003

(51) Int. Cl.[7] ..... E04H 4/00
(52) U.S. Cl. ..... 4/498; 4/503
(58) Field of Search ..... 4/498, 503; 135/115, 135/124, 135, 136

(56) References Cited

U.S. PATENT DOCUMENTS

| | | | | |
|---|---|---|---|---|
| D213,867 S | | 4/1969 | Perlman | |
| 3,512,186 A | | 5/1970 | Sanford | |
| 4,136,408 A | | 1/1979 | Dahlbeck et al. | |
| 4,685,254 A | | 8/1987 | Terreri | |
| 4,951,327 A | * | 8/1990 | Del Gorio, Sr. | 4/498 |
| 4,953,239 A | | 9/1990 | Gadsby | |
| 5,144,704 A | | 9/1992 | Genzel et al. | |
| 5,706,531 A | * | 1/1998 | Aubertine | 4/498 |
| 6,381,767 B1 | * | 5/2002 | Brashears | 4/498 |
| 6,442,773 B1 | * | 9/2002 | Kopyar et al. | 4/498 |

* cited by examiner

*Primary Examiner*—Tuan Nguyen
(74) *Attorney, Agent, or Firm*—Donald R. Schoonover

(57) ABSTRACT

A pool cover support includes a base that rests on the bottom of a pool to be covered and a standard fixed to that base. A pole is adjustably and releasably connected to the standard and a plurality of bows are releasably attached to the pole. An S-shaped sleeve is releasably and adjustably attached to each rib and a flange is used to attach each sleeve to a side of the pool to be covered.

3 Claims, 1 Drawing Sheet

POOL COVER SUPPORT

BACKGROUND OF THE INVENTION

1. Field of the Invention

The present invention relates to the general art of supports, and to the particular field of pool covers.

2. Discussion of the Related Art

Many people own pools, either in ground type pools or above ground type pools. Generally, pools must be covered for some part of the year. A problem arises when a pool is covered because water and debris may collect on the cover. This water and debris must be removed from the cover before the cover is removed from the pool. Standing water is not desirable and such water should be removed from a pool cover even if the cover is to remain covering the pool.

While the art contains several examples of systems used to remove water and/or debris from a pool cover, these existing systems have several drawbacks, including cost and time consumption during maintenance and set up and/or disassembly.

Therefore, there is a need for a means for efficiently maintaining a pool cover free of water and/or debris.

To be most efficient, a pool cover should be adaptable to a wide variety of pool sizes and shapes. Many presently-available pool covers are either circular or polygonal and are not amenable to size changes. Therefore, some covers must be modified either in size or shape to fit various sized and shaped pools. Any means associated with such modified pool covers should be amenable to use with such modified pool covers.

Therefore, there is a need for a pool cover support that can be used with a wide variety of pool cover sizes and shapes.

Still further, a pool cover and any accessories associated therewith should be easy to set up and dismantle and easy to store. If these criteria are not met, the pool cover and any accessories associated therewith may not receive as wide a commercial acceptance as possible.

Therefore, there is a need for a pool cover support that is easy to set up and dismantle and is also easy and efficient to store.

Some pool owners already have pool covers in the form of tarps or the like. In order to be most widely accepted, any pool covering system accessory should be amenable for use with such existing equipment. In this way, a pool owner can improve his equipment without expending a great deal of money.

Therefore, there is a need for a pool cover support that can be used with tarps or other such covers that may already be owned by a pool owner.

PRINCIPLE OBJECTS OF THE INVENTION

It is a main object of the present invention to provide a means for efficiently maintaining a pool cover free of water and/or debris.

It is another object of the present invention to provide a pool cover support that can be used with a wide variety of pool cover sizes and shapes.

It is another object of the present invention to provide a pool cover support that is easy to set up and dismantle and is also easy and efficient to store.

It is another object of the present invention to provide a pool cover support that can be used with tarps or other such covers that may already be owned by a pool owner.

SUMMARY OF THE INVENTION

These, and other, objects are achieved by a support for a pool cover which includes a standard mounted on a base that is adapted to rest on the bottom of a pool to be covered and a cover support unit releasably and adjustably mounted on the standard. The cover support unit includes a plurality of S-shaped sleeves releasably and adjustably attached to arcuate bows that are releasably attached to a cover support unit. The bows and sleeves form S-shaped rib units. The cover support unit is fixedly attached to a pole that is releasably and adjustably attached to the standard. Flanges on the sleeves are used to releasably attach the ribs to the side of the pool to be covered.

The support embodying the present invention can be adjusted so a cover supported thereon slopes downwardly from the middle of the cover toward the ends of the cover. Thus, water will flow off of the cover. Any debris on the cover is subject to being washed away by the water flowing off the cover. The gentle S-shape of the sleeves and ribs supports the cover in a secure manner.

The support embodying the present invention has several adjustable joints so the support is amenable for use with a wide variety of cover sizes and shapes. The support of the present invention is also easy to assemble and dismantle and thus is easy to store and is amenable to use with tarps or the like that a pool owner may already own and which may have been customized for his or her pool. Thus such a pool owner need not purchase new tarps or other such covers in order to use the pool support embodying the present invention.

Thus, the support embodying the present invention is versatile, inexpensive and easy to use even with equipment already owned by a pool owner.

BRIEF DESCRIPTION OF THE DRAWING FIGURES

DETAILED DESCRIPTION OF THE PREFERRED EMBODIMENT

Figure 2:
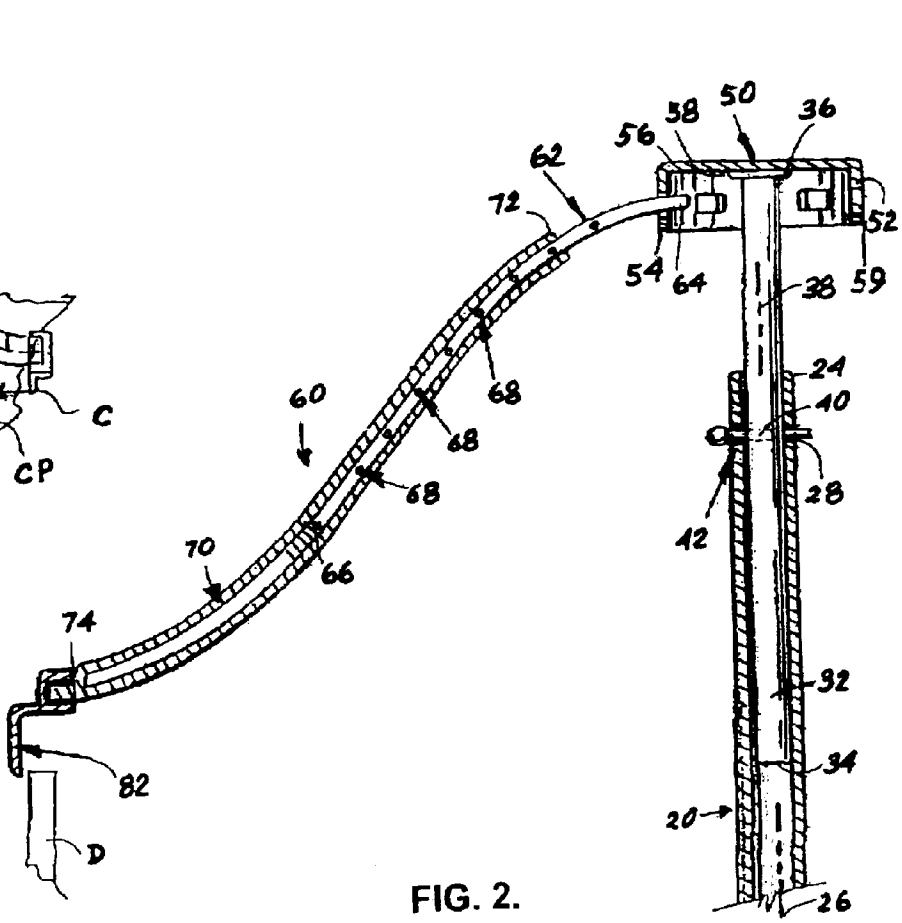
FIG. 2 is an enlarged, elevational view of a portion of the pool cover support embodying the present invention.

Other objects, features and advantages of the invention will become apparent from a consideration of the following detailed description and the accompanying drawings.

Referring to the Figures, it can be understood that the present invention is embodied in a support 10 for a pool cover. Support 10 comprises a base 12 which has a bottom surface 14, adapted to rest on a bottom surface S of a swimming pool that is being covered, and a top surface 16.

A hollow support standard 20 has a proximal end 22 fixedly secured to the top surface 16 of the base 12, a distal end 24, and a longitudinal axis 26 extending between the proximal end 22 of the hollow support standard 20 and the distal end 24 of the support standard 20. A stop pin-accommodating hole 28 is defined in the support standard 20 near the distal end 24 of the support standard 20.

Figure 1:
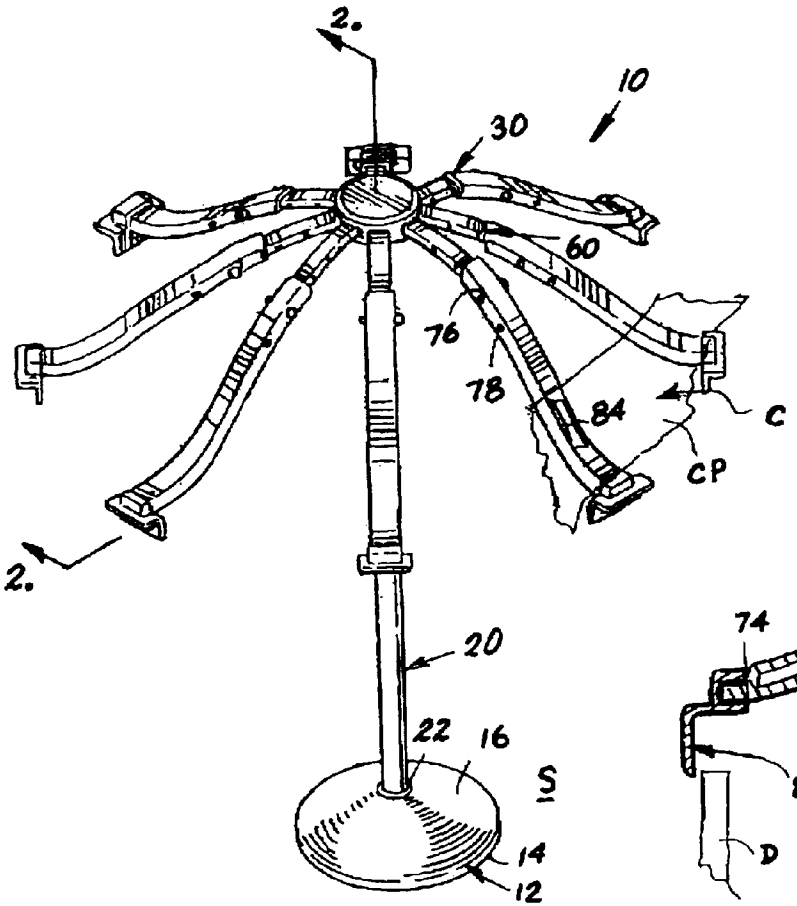
FIG. 1 is a perspective view of a pool cover support embodying the present invention in an assembled condition.

A cover support unit 30 is releasably and adjustably mounted on the support standard 20. Cover support unit 30 includes a support pole 32 which has a proximal end 34, a distal end 36, and a longitudinal axis 38 which extends between the proximal end 34 of the support pole 32 and the distal end 36 of the support pole 32. The support pole 32 is sized relative to the support standard 20 to be telescopingly received in the support standard 20 in a use condition as shown in FIG. 1. The longitudinal axis 38 of the support pole 32 is co-linear with the longitudinal axis 26 of the hollow support standard 20 when the support pole 32 is telescopingly received in the support standard 20. The support pole 32 further includes a plurality of stop pin-accommodating holes, such as hole 40, defined through the support pole 32. The stop pin-accommodating holes 40 are spaced apart from each other in the direction of the longitudinal axis 38 of the support pole 32.

A stop pin 42 extends through the stop pin-accommodating hole 28 defined in the support standard 20 and through an associated one of the stop pin-accommodating holes 40 to releasably and adjustably attach the support pole 32 to the support standard 20.

A support element 50 is fixedly secured to the distal end 36 of the support pole 32. Support element 50 includes a cylindrical side wall 52 having a rim 54. A central wall 56 is connected to the cylindrical side wall 52 and has an inner surface 58. The distal end 36 of the support pole 32 is fixedly secured to the inner surface 58 of the central wall 56 of the support element 50 and the side wall 52 of the support element 50 extends in the direction of the longitudinal axis 38 of the support pole 32. A plurality of rib-accommodating holes, such as hole 59, are defined through the side wall 52 of the support element 50.

A plurality of rib units, such as unit 60, are secured to the support element 50. The rib units 60 are identical, and each rib unit 60 includes an arcuate bow 62 having a proximal end 64 fixable to the support element 50, via one of the rib-accommodating holes 59, and a distal end 66. A plurality of adjustment holes 68 are defined through the bow 62.

An S-shaped hollow sleeve 70 has a proximal end 72 and a distal end 74. Each sleeve 70 telescopingly receives an arcuate bow 62 via the proximal end 72 of the sleeve 70. Each sleeve 70 further includes an adjustment pin-accommodating hole 76.

An adjustment pin 78 extends through the adjustment pin-accommodating hole 76 and an associated adjustment hole 68 in the bow 62 received in the sleeve 70 to attach the sleeve 70 to the bow 62. As shown in FIG. 1, more than one adjustment pin-accommodating hole 76 can be defined in each sleeve 70 and thus more than one adjustment pin 78 can be used to attach a sleeve 70 to a bow 62. This arrangement provides additional security to the connection between a sleeve 70 and a corresponding bow 62.

A flange 82 is fixed to the distal end 74 of each sleeve 70 and is adapted to fix the sleeve 70 to a side D of the pool.

A cover-attaching element 84 is located on each sleeve 70. The cover-attaching elements 84 can be hook-and-loop material that is associated with similar material on the cover, or can be pins, or other such fasteners that are used to attach flexible cloth, such as tarps or the like, to solid elements such as the sleeves 70. Those skilled in the art will understand what type of fastner is used and such fastners are intended to be within the scope of this disclosure.

As indicated in FIG. 1, a cover C is supported on top of the support 10 in the fashion of an umbrella with panels CP being defined between adjacent sleeves 70. The cover will shed water and debris because the center of the cover adjacent to support element 50 is higher than the end of the cover adjacent to flanges 82 as can be understood from the teaching of FIG. 2. The support 10 is easily assembled and disassembled and adjusted using the pins and aligned holes discussed above. The disassembled elements are easily stored as well.

It is understood that while certain forms of the present invention have been illustrated and described herein, it is not to be limited to the specific forms or arrangements of parts described and shown.

What is claimed and desired to be covered by Letters Patent is:

1. A support for a pool cover comprising:

a) a base having a bottom surface adapted to rest on a bottom surface of a swimming pool that is being covered, and a top surface;

b) a hollow support standard having a proximal end fixedly secured to the top surface of said base, a distal end, a longitudinal axis extending between the proximal end of said hollow support standard and the distal end of said support standard, and a stop pin-accommodating hole defined in said support standard near the distal end of said support standard;

c) a cover support unit releasably and adjustably mounted on said support standard and which includes (1) a support pole having a proximal end, a distal end, a longitudinal axis extending between the proximal end of the support pole and the distal end of the support pole, the support pole being sized relative to said support standard to be telescopingly received in said support standard in a use condition, the longitudinal axis of the support pole being co-linear with the longitudinal axis of said hollow support standard when the support pole is telescopingly received in said support standard, the support pole further including a plurality of stop pin-accommodating holes defined through the support pole, the stop pin-accommodating holes being spaced apart from each other in the direction of the longitudinal axis of the support pole, (2) a stop pin which extends through the stop pin-accommodating hole defined in said support standard and through an associated one of the stop pin-accommodating holes to releasably and adjustably attach the support pole to said support standard, (3) a support element fixedly secured to the distal end of the support pole of said cover support, the support element including (A) a cylindrical side wall having a rim, (B) a central wall connected to the cylindrical side wall and having an inner surface, the distal end of the support pole being fixedly secured to the inner surface of the central wall of said support element with the side wall of the support element extending in the direction of the longitudinal axis of the support pole, and (C) a plurality of rib-accommodating holes defined through the side wall of the support element, and (D) a plurality of rib units secured to the support element, each rib unit including (i) an arcuate bow having a proximal end fixable to the support element via a rib-accommodating hole, a distal end and a plurality of adjustment holes defined through the bow, (ii) an S-shaped hollow sleeve having a proximal end and a distal end, each sleeve telescopingly receiving an arcuate bow via the proximal end of the sleeve, each sleeve further including an adjustment pin-accommodating hole, (iii) an adjustment pin which extends through the adjustment pin-accommodating hole and an associated adjustment hole in the bow received in the sleeve to attach the sleeve to the bow, and (iv) a flange fixed to the distal end of each sleeve and adapted to fix the sleeve to a side of the pool; and d) a cover attaching element on each sleeve.

2. The support as described in claim 1 further including a cover releasably attached to said cover-attaching element on each sleeve.

3. A support for a pool cover comprising:

a) a support unit which includes a standard, the support unit being adapted to rest on a bottom surface of a swimming pool to be covered;

b) a support pole telescopingly received in said support unit;

c) a plurality of S-shaped arms releasably connected to said support pole, each arm including an arcuate bow element and an S-shaped sleeve with the bow element being telescopingly received in the sleeve; and d) a flange on a distal end of each S-shaped sleeve which is adapted to be connected to a side of the pool being covered.

* * * * *